United States Patent [19]

Walters et al.

[11] Patent Number: 4,598,626

[45] Date of Patent: Jul. 8, 1986

[54] FEEDBACK CONTROLLED HYDRAULIC VALVE SYSTEM

[75] Inventors: Ronald B. Walters, Wembley; John A. G. Hammond, Hayling Island, both of England

[73] Assignee: Vickers, Incorporated, Troy, Mich.

[21] Appl. No.: 685,204

[22] Filed: Dec. 24, 1984

Related U.S. Application Data

[63] Continuation of Ser. No. 408,757, Aug. 17, 1982, abandoned.

[30] Foreign Application Priority Data

Aug. 21, 1981 [GB] United Kingdom ..... 8125584

[51] Int. Cl.[4] ..... F15B 11/10

[52] U.S. Cl. ..... 91/433; 91/459; 91/461; 137/625.64

[58] Field of Search ..... 91/433, 461, 459; 137/625.64, 625.63; 73/861.47, 720, 861.56

[56] References Cited

U.S. PATENT DOCUMENTS

| | | | |
|---|---|---|---|
| 862,867 | 8/1907 | Eggleston | 417/390 |
| 2,867,757 | 1/1959 | Wagner | 73/861.47 X |
| 2,920,487 | 1/1960 | Green | 73/720 |
| 3,763,746 | 10/1973 | Walters | 91/433 |
| 3,878,765 | 4/1975 | Walters et al. | 91/433 |
| 4,031,813 | 6/1977 | Walters et al. | 137/625.64 X |

FOREIGN PATENT DOCUMENTS 1462879 1/1977 United Kingdom .

*Primary Examiner*—Edward K. Look

*Attorney, Agent, or Firm*—Barnes, Kisselle, Raisch, Choate, Whittemore & Hulbert

[57] ABSTRACT

A hydraulic system in which a pilot operated hydraulic four-way main valve (11) controls the direction and rate of fluid flow to a hydraulic load (13), includes a flow sensor (15) which is capable of operating bidirectionally and may therefore be located in one of the service lines (25, 26) from the main valve (11) to the load (13). The main components of the flow sensor are a variable or fixed aperture flow sensing orifice (52, 53), and a pressure transducer (18) to which the pressure differential developed across the orifice is applied and which converts the pressure differential into an electric negative feedback signal. This electric feedback signal is compared in an electronic circuit (17) with a demand signal, and a corresponding command signal sets the pilot valve (12) which controls the main valve (11). The pressure transducer (18) in the described embodiment is a cantilever beam pressure transducer (36), acted on by the inner ends of a pair of diameter-matched sliding pins (34, 35), across the outer ends of which the pressure differential is applied.

8 Claims, 2 Drawing Figures

FEEDBACK CONTROLLED HYDRAULIC VALVE SYSTEM

Figure 1:
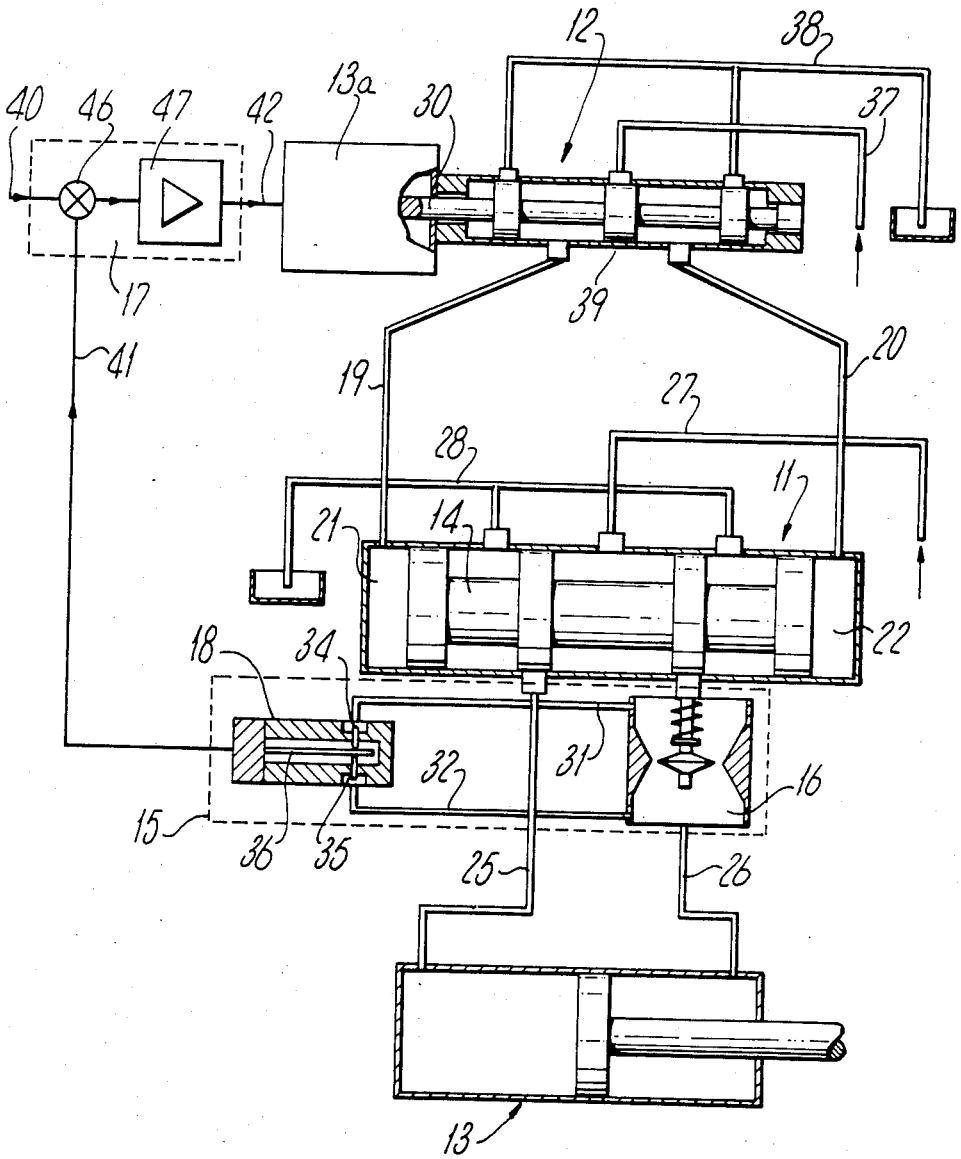

This application is a continuation of application Ser. No. 408,757, filed Aug. 17, 1982, now abandoned.

This invention relates to hydraulic systems, and in particular to hydraulic systems having pilot valve controlled four-way valves to regulate rate and direction of fluid flow to a hydraulic load.

G.B. Pat. No. 1462879 (Sperry Rand Limited) discloses a hydraulic system including a pressure operated, pilot valve controlled, four-way valve, in which a mechanical-to-electrical transducer converts directly the amount of displacement of the movable element of a flow sensor into a corresponding electric feedback signal which, in turn, is compared with a demand input signal to derive a command signal to set the pilot valve accordingly. The conversion from displacement to electric signal is achieved by mechanically linking the movable element to the sliding contact of a potentiometer. This form of feedback signal generation, although generally quite satisfactory, does have disadvantages, some of which are most noticable at very low rates of fluid flow and arise, in the main, from the frictional forces which the movable element has to overcome before a flow feedback signal is obtained.

The present invention has as one of its aims to provide an improved flow feedback for four-way valves, and the invention springs from the recognition that a generally more sensitive and reliable flow feedback is obtained if the flow feedback signal is generated, instead of directly from the displacement of a movable flow sensing element, from the pressure differential which is developed across a flow sensing orifice of a flow sensing device.

To achieve this aim, the invention employs a flow sensing device having a flow sensing orifice and pressure transducer means which receive the pressure differential developed in operation across the flow sensing orifice and convert the pressure differential into a corresponding electric flow feedback signal.

The flow sensing device is conveniently bi-directional so that it may be located, either in one of the service lines, or in the supply line, or in the tank return line of the valve. The flow sensing orifice may have a fixed aperture, or the aperture may be variable, e.g. by being formed between a fixed throat and a movable element on which acts a return force which tends to restore the movable element to its neutral position. The return force will normally be provided by a spring whose elastic properties may, additionally, be chosen to give a substantially linear pressure-against-flow curve.

A single pressure transducer may be used to convert pressure differentials created by flow in both the forward and the reverse directions, in which case, if the flow sensor is to be located in one of the service lines, it must be capable of converting pressure differentials of either polarity into corresponding electric flow feedback signals.

Some of the advantages of the present invention over various prior art arrangements are, firstly, that it provides a choice of using a fixed or a variable flow sensing orifice according to the desired application; secondly, where the application requires a variable orifice flow feedback is nevertheless obtained even before the rate of flow is sufficiently great to move the movable element to any appreciable extent.

Furthermore, the use of a bi-directional flow sensing device permits the feedback signal generation from the flow to and from the actuator, rather than the flow supplied to, or returned from the valve. This itself has several advantages. To begin with, the sensed rate of fluid flow is as nearly as possible the same as the flow utilized by the actuating means, since fluid losses due, for instance, to leakage within the main valve and to fluid supply to the pilot valve, do not enter the measurement. Also, no special means are required to compensate for asymmetries in the load such as, e.g., unequal piston areas of the actuator, because fluid flow is always sensed relative to the same side of the load. Nor is it necessary, as it would be if flow were to be sensed in the uni-directional supply line, to provide a separate feedback reversing facility, (e.g. a reversing switch for the feedback signal) to keep feedback negative irrespective of the direction of fluid flow through the service lines. The bi-directional flow sensing means sense both direction and quantity of flow, and automatically reverse the feedback signal when the direction of flow is reversed. Being able to dispense with a separate feedback reversal facility greatly inproves operating performance of the valve in controlling flow in the vicinty of null.

Figure 2:
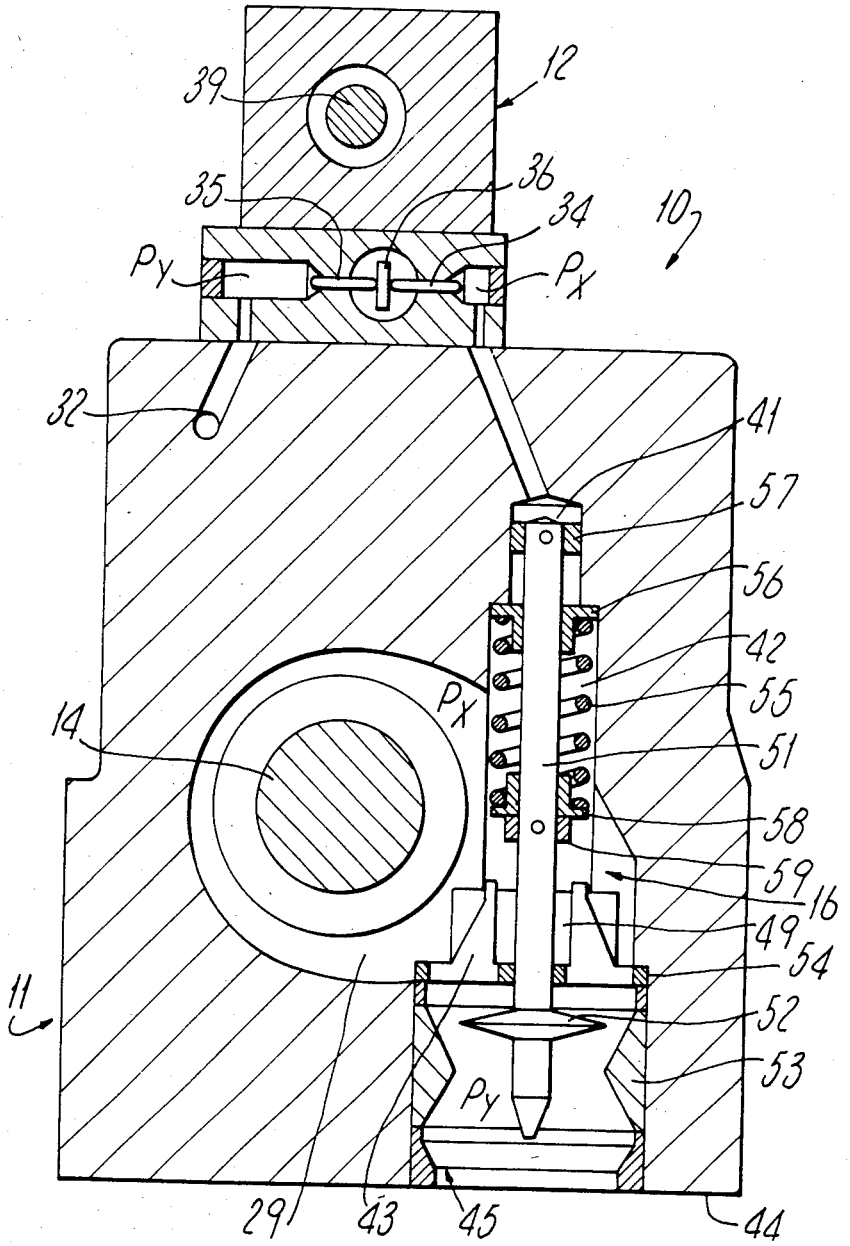

The present invention will now be explained further with the aid of an example described with reference to the accompanying drawings, of which:

FIG. 1 is a functional diagram of a hydraulic system incorporating the present invention; and FIG. 2 is a schematic sectional view of a practical four-way valve for the hydraulic system of FIG. 1.

Referring first to FIG. 1, the main components of the illustrated hydraulic system are: a main valve 11 in the form of a pressure operated four-way spool valve the position of the spool 14 of which controls the operation of the hydraulic actuator 13; a pilot spool valve 12 which is actuated by a force motor 13*a* and controls the pressures in end chambers 21 and 22 of the main valve 11 and hence both direction and magnitude of the flow through the main valve 11; and a flow sensing arrangement 15, which is located in service line 25 leading from the main valve 11 to one side of the hydraulic actuator 13, the other side of the actuator 13 being connected to the main valve through service line 26.

The flow sensing arrangement 15 consists of a flow sensing device 16 (see also Fig. 2), and pressure transducing means in the form of a cantilever beam pressure transducer 18. Fluid lines 31 and 32 serve to transmit the pressures extant at the respective sides of the sensing orifice to the outer ends of a pair of pins 34 and 35 of matched diameters. The other, inner, ends of the pins 34 and 35 contact the cantilever beam 36 of the pressure transducer 18 on opposite faces near its free end. Any imbalance in the forces applied to the cantilever beam 36 by the pins 34 and 35 cause the beam 36 to bend about its fixed end. Applying a pressure differential across the outer ends of the pins 34 and 35 thus produces a corresponding electric flow feedback signal, which constitutes one input, via lead 41, to the electronic circuit 17.

Briefly, and without going into too many details as to its construction, the primary function of the electronic circuit 17 is to compare the flow feedback signal on lead 41 with the demand signal on lead 40, and to derive from this comparison an appropiate command signal to control the pilot valve 12. Thus, both a demand voltage and feed-back voltage are applied to the summing junction 46. The output signal of the summing junction 46 is an error voltage which is applied to the input of an amplifier 47, which provides at its output a command signal current which is commensurate with the error input voltage to the amplifier 47 and is applied via a lead 42 to the force motor 13. Apart from its primary function, the electronic circuit 17 may, of course, also fulfil other functions pertinent to the requirements of the hydraulic system in question.

Depending on the direction in which the actuator is to be moved, fluid is supplied to the actuator via service line 25 and the fluid displaced by the movement of its piston is returned to the valve via service line 26, or fluid is supplied to the actuator via line 26 and returned via line 25. Thus, fluid flow through both service lines, 25 and 26, is bi-directional. Service lines 25 and 26, together with fluid lines 27 and 28 through which fluid is supplied to the valve 11 and returned from the valve 11 to tank (indicated in the drawing by the U-shaped symbol) form the principal fluid lines of the system. The system includes also ancillary fluid lines, such as the supply line 37 and the tank return line 38 of the pilot valve 12, with line 37 being in practice usually branched off the supply line 27 within the body of the main valve 11.

FIG. 2 is a schematic transverse section, viewed along the axis of the main valve spool 14, through a four-way valve 10. The valve 10 is an assembly comprising the main valve 11, the pressure transducer 18 atop the main valve, and the pilot valve 12, with attached force motor (not shown), mounted on top of the pressure transducer 18.

The flow sensing device 16 is located in the valve 11 in a cavity which is formed by the external service line port 45 leading to the internal service line port 29, and the bore 42 terminating in the narrower bore 41. The internal service line port 29, and other internal ports of the main valve 11 and the pilot valve 12, are formed in the usual manner, for instance by circumferential recesses of limited width to the bores containing the valve spools.

The flow sensing device 16 has as its main components a throat 53, a movable discus-shaped element 52 mounted on a shaft 51, and a return spring assembly which tends to restore the discus 52 together with the shaft 51, to its neutral position, irrespective of whether the discus 52 is lowered below or, as illustrated in FIG. 2, raised above its neutral position. The neutral position of the discus 52 is that position in which its outer edge lies in the plane defined by the inner edge of the throat 53. The shaft 51 is restrained radially by a central aperture in a web 54 through other apertures 43 of which fluid passes from the internal port 29 to the external port 45 or vice versa. The shaft 51 carries near its upper end a collar 57 which makes a sliding fit with the side wall of the bore 41 when the shaft 51 is raised. A similar collar 59 is fixed to the shaft 51 approximately halfway along its length, both collars being secured to the shaft by locking pins.

The collar 59 is shown as abutting from below against a flanged sleeve 58 secured to the lower end of the return spring 55. Another flanged sleeve 56 at the upper end of the spring 55 is seen resting against the shoulder formed by the transition between bores 42 and 41. Both flange sleeves make a sliding fit with the shaft 51 and, unlike the lower sleeve 58 which is spaced from the side wall of the bore 42, the outer rim of the upper flanged sleeve 56 also makes a sliding fit with the side wall of the bore 42.

The central aperture of the web 54 widens in its upper part to a diameter sufficiently large to accommodate the collar 59 when the shaft 51 is lowered to or below the neutral position of the discus 52. When the shaft 51 is so lowered, the flanged sleeve 58 is urged against the upper edge of the web 54, while the collar 57 now engages the upper flanged sleeve 56 from above and progressively pushes it down as the shaft 51 is lowered. In order to obtain sensitive flow feedback about null, the spring 55 will normally preload the discus 52 in the neutral position so that the non-linear feedback characteristics of a fixed orifice flow sensor are obtained at low flow rates.

The fluid pressure $P_X$ which is present above the discus 52 and in the port 29, is transmitted by way of the passage 31 from the upper end of the bore 41 to the right-hand chamber of the pressure transducer 18. The pressure $P_Y$ below the discus 52 is transmitted to the left-hand chamber of the pressure transducer 18 through the passage 32, of which only the uppermost section is shown in the drawing, the passage being a suitably routed internal passage terminating below the throat 53 in the port 45. The pressure of the fluid in each of the two chambers in the pressure transducer 18 acts on the cross-section of the respective slidable pin, 34 and 35, and hence on the cantilever beam 36 (shown head-on in FIG. 2) in the manner described earlier.

Referring now to FIG. 1 and FIG. 2, in operation, movement of the actuator 13 is initiated by supplying a demand signal along lead 40 to the electronic circuit 17, and hence to the force motor 13*a*. The force motor acts on shaft 30 and axially moves the spool 39 of the pilot valve 12 in the appropriate direction. Assuming for the purpose of explanation that it is desired that the hydraulic actuator 13 move towards the left, and ignoring for the moment the pressure drops developed between each land of the spools and the corresponding ports, the force motor shifts the pilot spool towards the right-hand side and, accordingly, fluid from the supply line 37 is admitted via the left-hand chamber of the pilot valve and the line 19 to the left end-chamber 21 of the main valve. At the same time, the line 20 is connected via the right-hand chamber of the pilot valve to tank. Consequently, the pressure in the left end chamber 21 exceeds the pressure in the end chamber 22, and the main valve spool executes a move towards the right. This movement establishes connections, on the one hand, between the supply line 27 and the service line 26 and, on the other hand, between the service line 25 and the return line 28 to tank. The higher pressure in the service line 26 will cause the piston of the actuator 13 to move towards the left, the fluid at the left of the piston which is displaced by this movement being returned to tank via the service line 25, the main valve 11, and the return line 28.

On account of the pressure drop generated by fluid flowing through a restricted aperture, a small pressure differential develops across the orifice of the flow sensing device 16 as a result of the onset of fluid flow in the service line 25. This pressure differential, which constitutes the difference between the pressures $P_X$ and $P_Y$ in FIG. 2 on opposite sides of the discus 52, is transmitted to the pressure transducer 18, where it is converted into the flow feedback signal which is then supplied to the electronic circuit 17. If, say, the flow feedback signal indicates that the flow is lower than the desired value, the resulting command signal will, in the terms of the above example, be such as to keep the pilot spool shifted to the right, so maintaining the pressure difference between the left and right chamber 21 and 22 of the main valve, and causing the main valve spool to move further to the right and so increase the flow to the actuator.

Once the desired rate of flow has been achieved, the command signal will be such as to return the pilot spool 39 to its central position and, since the main valve spool will have moved until the pressure in both chambers 21 and 22 are equal, the main valve spool 14 is locked into position, and the desired flow maintained.

If, on the contrary, the flow feedback signal indicates that flow in the service line 25 is too high, the command signal to the force motor will be such as to cause the pilot spool 39 to move towards the left and the leftward movement of the main valve spool 14 will cause a reduction in the flow to the actuator 13.

A change either in the desired flow rate, or in the desired direction, or in both these is achieved by changing the demand signal with the result that the discrepancy between the flow feedback signal and the new demand signal produces a new error signal. This new error signal generates a command signal which operates on the pilot valve such as to restore equality between the demand signal and flow feedback signal.

As the flow of fluid through the flow sensing device 16 increases, the discus 52 is lowered below, or raised above, the neutal position, depending on the direction of fluid flow. The aperture of the flow sensing orifice, between the throat 53 and the discus 52, correspondinly increases, keeping the absolute value of the pressure difference $P_X - P_Y$ less than it would have been in the case of a fixed orifice. Accordingly, a variable orifice will generally allow for a greater range of permissible flows than a fixed orifice.

As it is not simply the displacement of the discus 52 from which the feedback signal is obtained, but instead the pressure differential developed across the orifice, even fluid flow insufficiently high to overcome the frictional forces and, where applicable, the preload which tend to retain the discus 52 in its previously occupied position, will nevertheless result in a feedback signal being obtained, even though the feedback signal may under these circumstances not vary exactly linearly with the rate of flow. Other events, such as, e.g., a broken return spring 55, may lead to immobilisation, or disproportionate displacement, of the discus 52, but in either case an, admittedly impaired, operation of the flow sensor in what amounts to a fixed orifice mode still provides a certain amount of flow feedback to the electronic circuit 17. The possibility of a complete and catastrophic failure in the hydraulic system is thus considerably reduced.

We claim:

1. A system for controlling the flow of hydraulic fluid to hydraulic actuator means, comprising fluid actuator means, a fluid pressure operated four-way main valve having ports, service lines connected to said ports and extending to said actuator means, a supply line and a tank return line, a pilot valve for controlling said main valve, said main valve regulating the flow of fluid to the actuator means, electrical input means for an electrical demand input signal, flow sensing means for producing an electric feedback signal dependent on the rate of fluid flow to the actuator means, and means for comparing the feedback signal with the demand signal and for operating the pilot valve accordingly, in which the flow sensing means comprise a flow sensing variable orifice means located in a port of the main valve to which is connected one of said fluid service lines to said actuator means, to measure fluid flow in said one fluid line by a pressure differential across said flow sensing orifice, and pressure transducer means hydraulically connected to opposite sides of said flow sensing orifice of said flow sensing device to receive and convert the generated pressure differential into the electric feedback signal such that the feedback signal is developed by the pressure differential across the orifice and results in a feedback signal even when the fluid flow is insufficiently high to overcome frictional forces on the movable element and the preload on the flow sensing means.

2. A system as claimed in claim 1, in which the flow sensing orifice is formed between a fixed throat and a movable element and means providing a return force counteracting the movement of said movable element due to the fluid flow.

3. A device as claimed in claim 2, in which the return force is constructed to act on the movable element such as to provide a pressure differential varying substantially linearly with the flow rate of the regulated fluid flow.

4. A device as claimed in claim 3, in which the pressure transducer means is a beam pressure transducer which is acted on in the region of its free end by the near ends of an opposing pair of matched pins across the far ends of which the pressure differential is applied.

5. A device as claimed in claim 4 wherein passages are provided in the valve and hydraulically connect the pressure transducer means to opposite sides of said flow sensing orifice of said flow sensing device.

6. A device as claimed in claim 5 wherein said pressure transducer means is mounted directly on the valve for communication with said passages.

7. The system as set forth in any one of claims 1, 2–6 wherein said flow sensing means comprises a bi-directional flow sensing device having a movable element.

8. A system as claimed in claim 1 wherein said flow sensing means comprises a single spring.

* * * * *